US009663342B2

(12) United States Patent
Lin

(10) Patent No.: US 9,663,342 B2
(45) Date of Patent: May 30, 2017

(54) FUNNEL ASSEMBLY

(71) Applicant: SHOU KING ENTERPRISE CO., LTD, Taichung (TW)

(72) Inventor: Ching-Chou Lin, Taichung (TW)

(73) Assignee: SHOU KING ENTERPRISE CO., LTD., Taichung (TW)

( * ) Notice: Subject to any disclaimer, the term of this patent is extended or adjusted under 35 U.S.C. 154(b) by 158 days.

(21) Appl. No.: 14/586,987

(22) Filed: Dec. 31, 2014

(65) Prior Publication Data

US 2016/0185585 A1 Jun. 30, 2016

(51) Int. Cl.
*B67C 11/02* (2006.01)
*F01M 11/04* (2006.01)

(52) U.S. Cl.
CPC ..... *B67C 11/02* (2013.01); *F01M 11/0458* (2013.01); *B67C 2011/027* (2013.01); *F01M 2011/0491* (2013.01)

(58) Field of Classification Search
CPC ..... B67C 11/00; B67C 11/02; B67C 11/04; B67C 2011/027; B65B 39/02; B65B 39/007; F16L 21/00; F16L 21/02; F16L 21/08; F16L 27/00; F16L 27/02; F16L 27/0837; F16L 27/0841; F16L 27/0845; F16L 25/06; F01M 11/04; F01M 11/0458; F01M 2011/0491
USPC ..... 222/460–462; 285/307; 141/331–345
See application file for complete search history.

(56) References Cited

U.S. PATENT DOCUMENTS 3,378,282 A * 4/1968 Demler, Sr. ..... F16L 13/141 138/89
3,939,884 A * 2/1976 Mader ..... B67C 11/02 141/333
5,228,488 A * 7/1993 Fletcher ..... B67C 11/04 141/331
5,349,997 A * 9/1994 Rial ..... A01G 25/14 138/155
5,692,620 A * 12/1997 Christensen ..... B03B 5/623 209/461
5,894,695 A * 4/1999 Stellatos ..... A47G 33/12 137/433
8,230,710 B2 * 7/2012 Brissette ..... B21D 15/02 72/46
2014/0196816 A1 * 7/2014 Liao ..... B65B 39/02 141/332

* cited by examiner

*Primary Examiner* — Timothy L Maust
*Assistant Examiner* — Andrew Stclair
(74) *Attorney, Agent, or Firm* — Raymond Y. Chan; David and Raymond PatentFirm

(57) ABSTRACT

A funnel assembly used for adding motor oil to cars or motorcycles is revealed. The funnel assembly includes a main body, a first sleeve, an extension tube, a second sleeve and a cover. The main body is connected to the first sleeve and the first sleeve is assembled with the extension tube. The extension tube is connected to the second sleeve and the second sleeve is assembled with the cover. The first sleeve and the extension tube can be assembled with each other toward different directions and so do the second sleeve and the cover. Thereby the funnel assembly can be applied to and mounted into oil fill holes at different positions of various cars.

11 Claims, 5 Drawing Sheets

FUNNEL ASSEMBLY

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

A funnel assembly is placed in an oil fill hole and used for pouring motor oil into cars or motorcycles. Thus the motor oil is poured into containers with the oil fill hole smoothly, without being spilled.

Description of Related Arts

A funnel is used to channel liquid or fine-grained substances into containers with a small opening. Without a funnel, the liquid may be spilled.

However, the positions of the oil fill holes on oil containers of various cars or motorcycles are different. The oil fill hole may be arranged at an upper or a lower place of the engine case. For users, it may be difficult to insert a stem of the funnel into the oil fill hole. The stem of the funnel is generally linear and there are various types of funnel, such as those revealed in Pat. No. ES1119986 and Pat. App. Pub. No. US2012152408.These funnels can be applied to oil fill holes at different positions. A flexible hose is connected to the funnel and a ball valve is arranged at the stem of the funnel so that the funnel can be rotated to different directions.

The shortcoming of the funnel revealed in Pat. App. Pub. No. US2012152408 is in that a flexible and bendable hose is used as the stem of the funnel However, the flexible hose is difficult to be fixed and positioned. The flexibility also causes trouble in use. The hose is easy to twist and is unable to be fixed. Once users don't hold the hose properly, the hose is easy to be released from the oil fill hole and the motor oil is spilled.

As to Pat. ES1119986, the ball valve on the stem is connected to a cap. After the cap being covered on the oil fill hole, the vector of phase of the funnel can be adjusted. The disadvantage of the device is in that the funnel is unable to be fixed at the position after adjustment. This is due to that there is no positioning member between the ball valve and the cap. Thus users need to hold the funnel with one hand while the other hand is used for pouring the motor oil. The funnel revealed in the Pat. US2012152408 also got the same problem.

SUMMARY OF THE PRESENT INVENTION

Therefore it is a primary object of the present invention to provide a funnel assembly able to be inserted into oil fill holes of various cars and allowing users to change assembly angle of the funnel assembly easily. Moreover, the funnel assembly is positioned right after the adjustment of the assembly angle. Thus the user can pour the motor oil conveniently, without spilling the motor oil out of the funnel assembly or the oil fill hole.

In order to achieve the above object, a funnel assembly used for adding motor oil into cars or motorcycles of the present invention includes a main body, a first sleeve, an extension tube, a second sleeve and a cover. All the components are detachable.

The main body (funnel) includes a receiving portion while the receiving portion having a first open end and a second open end.

The first sleeve consists of a first axial part and a second axial part.

The second sleeve is composed of a third axial part and a fourth axial part.

The extension tube includes a first opening and a second opening.

The cover includes a base and a threaded part. The base is arranged with a mounting hole.

The second open end of the main body (funnel) is connected to the first axial part of the first sleeve and the second axial part of the first sleeve is assembled with the first opening of the extension tube. The second opening of the extension tube is connected to the third axial part of the second sleeve while the fourth axial part of the second sleeve is assembled with the mounting hole of the cover.

The extension tube can be connected to and positioned with the first sleeve and the second sleeve at different angles for being adjusted to the direction required. The second sleeve and the cover can be connected to and positioned with each other at different angles.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
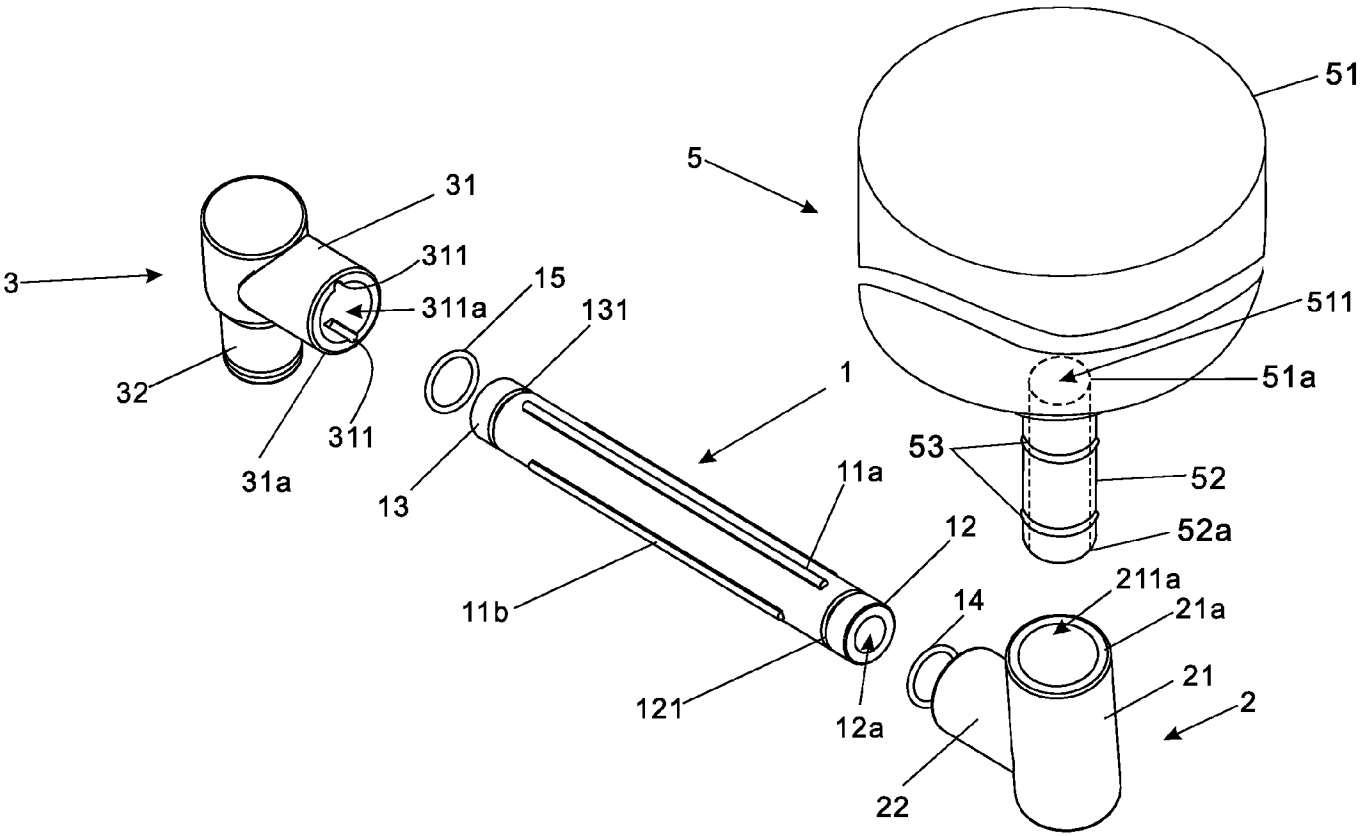
FIG. 1 is an explosive view of an embodiment according to the present invention.
Figure 2:
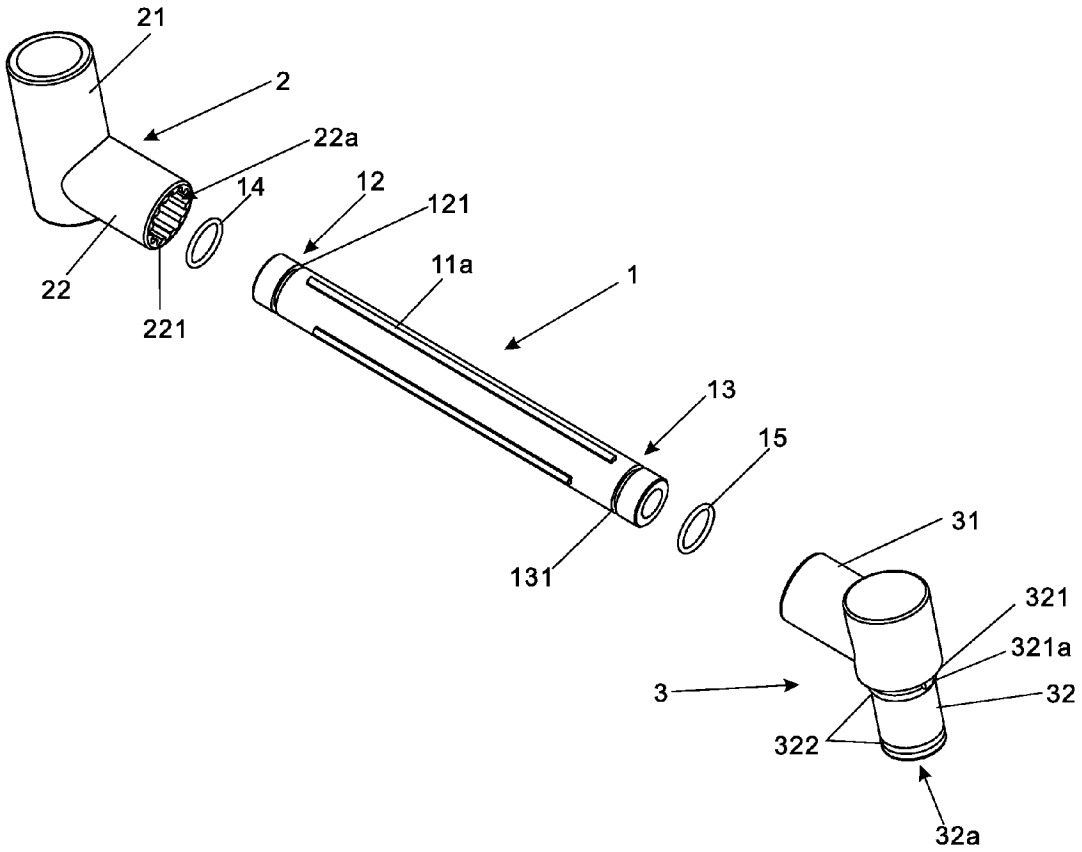
FIG. 2 is an explosive view of the embodiment in FIG. 1 viewed from another angle according to the present invention.

Please refer to following embodiments for details, features and effects of the present invention.

Refer from FIG. 1 to FIG. 4, the assembly includes a main body (funnel) 5, an extension tube 1, a first sleeve 2, a second sleeve 3 and a cover 4.

The main body (funnel) 5 consists of a receiving portion 51, a guide tube 52, at least one seal ring 53 fitted over an outer surface of the guide tube 52. The receiving portion 51 has a first open end 51*a* while the guide tube 52 has a second open end 52*a*. A first channel 511 is extended from the first open end 51*a* to the second open end 52*a*.

The first sleeve 2 is composed of a first axial part 21 and a second axial part 22. The first axial part 21 has a first opening end 21*a* while the second axial part 22 has a second opening end 22*a*. The second axial part 22 is formed by extension and bending of the first axial part 21. A second channel 211*a* is extended from the first opening end 21*a* to the second opening end 22*a*. A plurality of stopping slots 221 is disposed around an inner surface wall of the second opening end 22*a* at a certain interval.

The second sleeve 3 is formed by a third axial part 31 and a fourth axial part 32. The third axial part 31 has a first opening end 31*a* and the first opening ends 31*a* is arranged with positioning slots 311 while the fourth axial part 32 has a second opening end 32*a*. The third axial part 31 is extended and bent to form the fourth axial part 32. A fourth channel 311*a* is extended from the first opening ends 31*a* to the second opening end 32*a*. A step portion 321 with a projecting block 321*a* is set between the third axial part 31 and the fourth axial part 32. At least one seal ring 322 is fitted over the fourth axial part 32.

The extension tube 1 includes a first opening 12 and a second opening 13. A third channel 12*a* is extended from the first opening 12 to the second opening 13. A plurality of axial long ribs 11*a*, and short ribs 11*b* is arranged in turn around the surface of the extension tube 1 at a certain interval. A circular groove 121 is set on the outer surface of the extension tube 1 close to the first opening 12 and a seal ring 14 is fitted on the circular groove 121. A circular groove 131 is mounted on the outer surface of the extension tube 1 close to the second opening 13 and a seal ring 15 is fitted on the circular groove 131.

Figure 3:
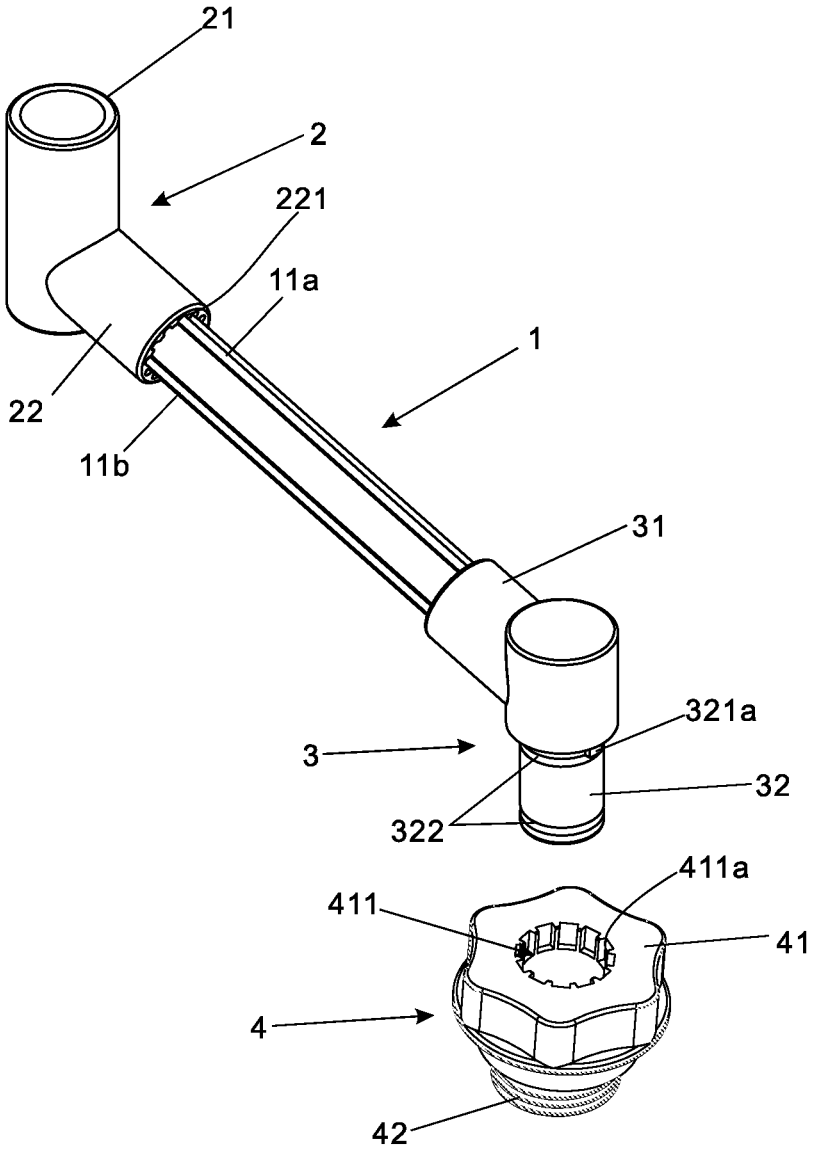
FIG. 3 is another explosive view of an embodiment according to the present invention.

As shown in FIG. 3, the cover 4 includes a base 41 and a threaded part 42. The base 41 is arranged with a mounting hole 411 and a plurality of concave parts 411*a* is disposed around an inner surface of the mounting hole 411 at a certain interval. A fifth channel 42*a* (not shown in figure) is extended from the mounting hole 411 to the threaded part 42. The threaded part 42 is used for connection to a oil fill hole.

The funnel assembly of the present invention is by the following way. First the second open end 52*a* of the main body (funnel) 5 is mounted into the first axial part 21 of the first sleeve 2. Then one of the long ribs 11*a* on the first opening 12 of the extension tube 1 is aligned with one of the stopping slots 221 on the second opening end 22*a* of the second axial part 22 and then the extension tube 1 and the first sleeve 2 are connected to each other. Moreover, one of the long ribs 11*a* on the second opening 13 of the extension tube 1 is aligned with one of the positioning slots 311 on the third axial part 31 of the second sleeve 3 and then the extension tube 1 and the second sleeve 3 are connected. At last, the projecting block 321*a* of the fourth axial part 32 of the second sleeve 3 is aligned with one of the concave parts 411*a* of the cover 4 and then the second sleeve 4 and the cover 4 are mounted and positioned with each other. Thereby the first sleeve 2 and the extension tube 1 are assembled and positioned with each other at a plurality of radial angles, and so are the second sleeve 3 and the cover 4.

Figure 4:
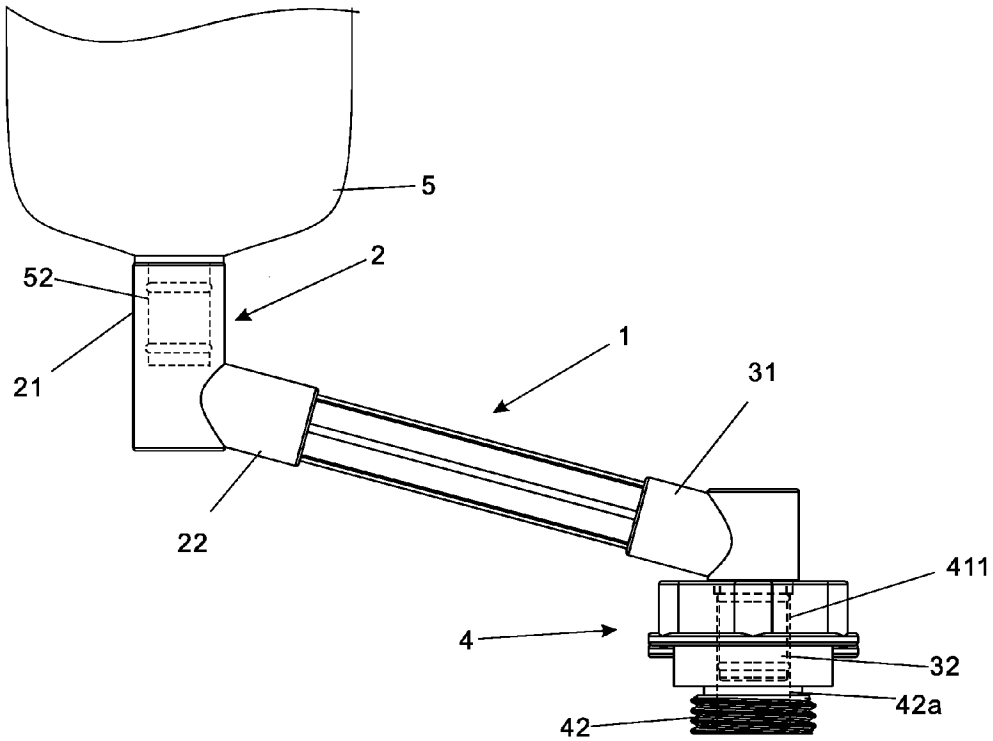
FIG. 4 is an assembled embodiment in use according to the present invention.

The funnel is used in the following manner for adding motor oil. Refer to FIG. 4, the threaded part 42 of the cover 4 is engaged with an inner diameter of the oil fill hole (on a oil container of cars or motorcycles). After confirming the position of the oil fill role at an engine case, assembly and locate the fourth axial part 32 of the second sleeve 3 according to the position of the oil fill hole. And the extension tube 1 is connected to the second sleeve 3. Then determine the optimal position of the second axial part 22 of the first sleeve 2, connect and position the second axial part 22 of the first sleeve 2 to the extension tube 1. At last, the guide tube 52 of the main body (funnel) 5 is mounted into the first axial part 21 of the first sleeve 2. The assembly of the funnel assembly with the oil fill hole(on the oil container of cars or motorcycles) has been completed. Users can pour motor oil into the receiving portion 51 of the main body (funnel) 5. The motor oil flows through the first channel 511, the second channel 211*a*, the third channel 12*a*, the fourth channel 31*a*, and the fifth channel 42*a* and then into the oil container.

It should be noted that both the first sleeve 2 and the second sleeve 3 have the bending design. The angle between the first axial part 21 and the second axial part 22 of the first sleeve 2 is no less than 90 degrees. The first sleeve 2 is defined as a tube bent at an angle ranging from 90 degrees to 120 degrees. The angle between the third t axial part 31 and the fourth axial part 32 of the second sleeve 3 is no less than 90 degrees. The second sleeve 3 is defined as a tube bent at an angle ranging from 90 degrees to 120 degrees. By the first sleeve 2 and the second sleeve 3 being connected to the extension tube 1, the tube formed has different pathways bent in different directions.

The funnel assembly of the present invention can be adjusted to various directions according to the following three-stage adjustment. The cover 4 is used for being fastened on the oil fill hole. The mounting hole 411 and the second sleeve 3 are connected to form a first adjustment portion for first-stage direction adjustment. The second sleeve 3 and the extension tube 1 are connected to form a second adjustment potion for second-stage direction adjustment while the extension tube 1 and the first sleeve 2 are assembled to form a third adjustment potion for third-stage direction adjustment. By the above three-stage adjustment, the funnel assembly can be assembled at different angles and adjusted to various directions.

The funnel assembly of the present invention has following advantages.

Figure 5:
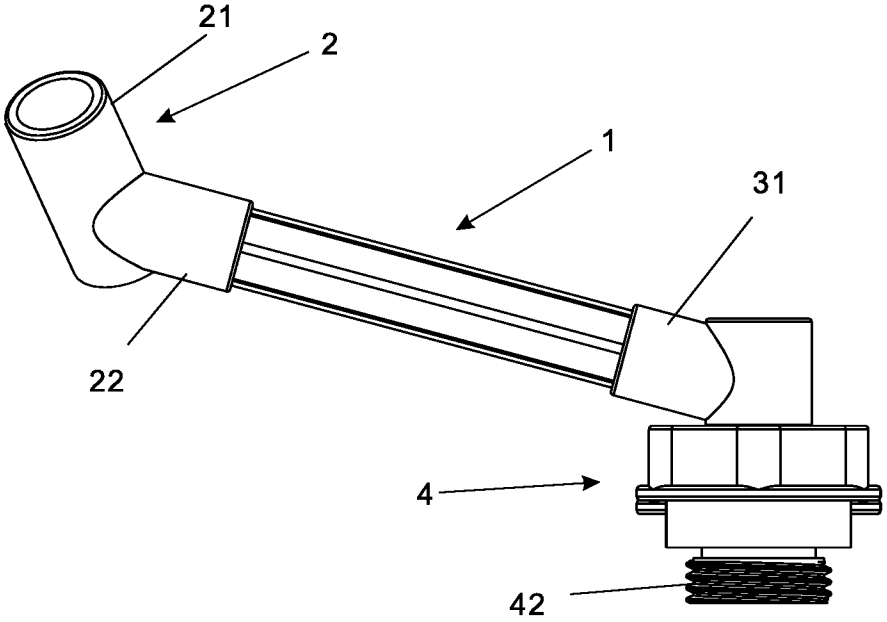
FIG. 5 is another assembled embodiment in use according to the present invention.

1. As shown in FIG. 4, a schematic drawing showing the assembled funnel assembly. Refer to FIG. 5, when the first sleeve 2 and the extension tube 1 are aligned with each other at different angle so that the first axial part 21 is toward another direction. The first sleeve 2 includes the first axial part 21 and the second axial part 22 while the second sleeve 3 includes the third axial part 31 and the fourth axial part 32. By changing angles of the second axial part 22, the third axial part 31, the first axial part 21 and the fourth axial part 32 being assembled with the extension tube 1, a tube formed by the sleeves 2, 3 and the extension tube 1 is bent toward different directions.

2. By the stopping slots 221 on the second opening end 22*a* of the first sleeve 2 and the positioning slots 311 on the first opening ends 31*a* of the second sleeve 3, the long ribs 11*a* of the extension tube 1 are connected to and positioned with each other at different radial angles, without shaking or rotation.

3. The concave parts 411*a* disposed on the mounting hole 411 of the cover 4 are selectable. After the projecting block 321*a* of the fourth axial part 32 of the second sleeve 3 is aligned with one of the concave parts 411*a* of the cover 4 selected. Thereby the second sleeve 3 can be connected and positioned at different angles, without shaking or rotation.

The funnel assembly of the present invention can be placed into the oil fill hole at different positions of oil containers of various cars. Thus users can easily change the assembly angle of the funnel assembly. The funnel assembly is also positioned just after the adjustment the assembly angle. No shaking or rotation occurs. The user can operate the funnel assembly conveniently and the motor oil is poured into engines smoothly, without being spilled out of the funnel or the oil fill hole.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A funnel assembly comprising:

a main body having a receiving portion, a guide tube and at least one seal ring fitted over an outer surface of the guide tube, the receiving portion further including a first open end and the guide tube having a second open end, wherein a first channel is extended from the first open end to the second open end;

a first sleeve including a first axial part and a second axial part, wherein the first axial part has a first opening end while the second axial part having a second opening end, wherein the first axial part is extended and bent to form the second axial part, wherein a second channel is extended from the first opening end to the second opening end and a plurality of stopping slots is disposed around an inner surface wall of the second opening end with a certain interval between two adjacent stopping slots;

a second sleeve including a third axial part and a fourth axial part, wherein the third axial part having a first opening end and the fourth axial part having a second opening end, wherein the third axial part is extended and bent to form the fourth axial part while a fourth channel is extended from the first opening end to the second opening end, wherein the first opening end of the third axial part is arranged with a plurality of positioning slots; a step portion, which is arranged with a projecting block, being set between the third axial part and the fourth axial part;

an extension tube including a first opening, a second opening, a plurality of axial ribs and at least two seal rings being respectively set on an outer surface of the extension tube at two ends thereof, wherein a third channel is extended from the first opening to the second opening, wherein the axial ribs are arranged in turn around a surface of the extension tube at a certain interval;

a cover including a threaded part and a base arranged with a mounting hole, wherein a plurality of concave parts being disposed around on an inner surface of the mounting hole at a certain interval, a fifth channel is extended from the mounting hole to the threaded part and the threaded part is used for connecting to an oil fill hole on an oil container of cars or motorcycles;

wherein the second open end of the main body is mounted into the first axial part of the first sleeve, wherein one of the axial ribs on the first opening of the extension tube is aligned with one of the stopping slots of the second axial part and the extension tube and the first sleeve are connected; one of the axial ribs on the second opening of the extension tube is aligned with one of the positioning slots on the third axial part of the second sleeve and the extension tube and the second sleeve are connected; the projecting block of the fourth axial part of the second sleeve is aligned with one of the concave parts of the cover and the second sleeve and the cover are mounted with and positioned by each other, wherein the first sleeve and the extension tube are connected to and positioned with each other; the second sleeve and the cover are connected to and positioned with each other wherein the second axial part of the first sleeve, the third axial part of the second sleeve and the extension tube are coaxially arranged along a length thereof.

2. The funnel assembly, as claimed in claim 1, wherein an angle between the first axial part and the second axial part of the first sleeve is no less than 90 degrees.

3. The funnel assembly, as claimed in claim 1, wherein an angle between the third axial part and the fourth axial part of the second sleeve is no less than 90 degrees.

4. The funnel assembly, as claimed in claim 1, wherein the first sleeve is a tube bent at an angle ranging from 90 degrees to 120 degrees.

5. The funnel assembly, as claimed in claim 1, wherein the second sleeve is a tube bent at an angle ranging from 90 degrees to 120 degrees.

6. A funnel assembly comprising:

a main body having a first open end and a guide tube, wherein the guide tube having a second open end and the first open end is communicated with the second open end;

a first sleeve including a first axial part and a second axial part, wherein the first axial part having a first opening end while the second axial part having a second opening end, wherein the first axial part is extended and bent to form the second axial part; a plurality of stopping slots is disposed around an inner surface wall of the second opening end with a certain interval between two adjacent stopping slots;

a second sleeve including a third axial part and a fourth axial part, wherein the third axial part having a first opening end and the fourth axial part having a second opening end, wherein the third axial part is extended and bent to form the fourth axial part, wherein the first opening end of the third axial part is arranged with a plurality of positioning slots; a step portion, which is arranged with a projecting block, being set between the third axial part and the fourth axial part;

an extension tube including a first opening, a second opening and a plurality of axial ribs, wherein the first opening and the second opening are communicated with each other; the axial ribs are arranged around a surface of the extension tube at a certain interval;

a cover including a threaded part and a base arranged with a mounting hole, wherein a plurality of concave parts is disposed around an inner surface of the mounting hole at a certain interval while the threaded part is used for connecting to an oil fill hole;

wherein the second open end of the main body is mounted into the first axial part of the first sleeve, wherein one of the ribs on the first opening of the extension tube is aligned with one of the stopping slots of the second axial part and the extension tube and the first sleeve are connected; one of the ribs on the second opening of the extension tube is aligned with one of the positioning slots on the third axial part of the second sleeve and the extension tube and the second sleeve are connected; the projecting block of the fourth axial part of the second sleeve is aligned with one of the concave parts of the cover and the second sleeve and the cover are mounted with and positioned by each other, wherein the first sleeve and the extension tube are connected to and positioned with each other; the second sleeve and the cover are connected to and positioned with each other wherein the second axial part of the first sleeve, the third axial part of the second sleeve and the extension tube are coaxially arranged along a length thereof.

7. The funnel assembly, as claimed in claim 6, wherein an angle between the first axial part and the second axial part of the first sleeve is no less than 90degrees.

8. The funnel assembly, as claimed in claim 6, wherein an angle between the third axial part and the fourth axial part of the second sleeve is no less than 90 degrees.

9. The funnel assembly, as claimed in claim 6, wherein the first sleeve is a tube bent at an angle ranging from 90 degrees to 120 degrees.

10. The funnel assembly, as claimed in claim 6, wherein the second sleeve is a tube bent at an angle ranging from 90 degrees to 120 degrees.

11. A funnel assembly comprising: a main body, a first sleeve, an extension tube, a second sleeve and a cover;

wherein the main body having a first open end and a guide tube, wherein the guide tube having a second open end and the first open end is communicated with the second open end;

wherein the first sleeve includes a first axial part and a second axial part, wherein the first axial part is connected to the second open end of the main body and the second axial part is connected to the extension tube;

wherein the first axial part is extended and bent to form the second axial part, wherein a plurality of stopping slots is disposed around an inner surface wall of the second axial part;

wherein the extension tube includes a first opening, a second opening, and a plurality of axial ribs, wherein the axial ribs are arranged around a surface of the extension tube at a certain interval;

wherein the second sleeve includes a third axial part and a fourth axial part, wherein the third axial part is extended and bent to form the fourth axial part, wherein a step portion, which is arranged with a projecting block, is set between the third axial part and the fourth axial part; the second axial part and the first opening of the extension tube are connected while the third axial part and the second opening of the extension tube are connected, wherein the second axial part of the first sleeve, the third axial part of the second sleeve and the extension tube are coaxially arranged along a length thereof;

wherein the cover including a threaded part and a base arranged with a mounting hole, wherein a plurality of concave parts is disposed around an inner surface of the mounting hole at a certain interval while the threaded part is used for connecting to an oil fill hole;

wherein the mounting hole of the cover and the second sleeve are connected to form a first adjustment portion for first-stage direction adjustment, wherein the second sleeve and the extension tube are connected to form a second adjustment potion for second-stage direction adjustment while the extension tube and the first sleeve are assembled to form a third adjustment potion for third-stage direction adjustment, wherein the funnel assembly is able to be assembled in various directions by the first-stage, second-stage, and third-stage direction adjustments.

* * * * *